US005708937A

United States Patent [19]

Lestrange et al.

[11] Patent Number: 5,708,937

[45] Date of Patent: Jan. 13, 1998

[54] LIQUID IMMERSION DEVELOPMENT MACHINE HAVING AN IMAGE NON-SHEARING DEVELOPMENT AND CONDITIONING IMAGE PROCESSING DEVICE

[75] Inventors: Jack T. Lestrange; Lawrence Floyd, Jr., both of Rochester, N.Y.

[73] Assignee: Xerox Corporation, Stamford, Conn.

[21] Appl. No.: 721,687

[22] Filed: Sep. 27, 1996

[51] Int. Cl.[6] ..... G03G 15/10; G03G 15/01

[52] U.S. Cl. ..... 399/239; 399/237

[58] Field of Search ..... 399/237, 239, 399/249, 245

[56] References Cited

U.S. PATENT DOCUMENTS

| | | | |
|---|---|---|---|
| 3,596,635 | 8/1971 | Smitzer | 399/240 |
| 5,121,704 | 6/1992 | Whitaker et al. | 399/233 |
| 5,570,173 | 10/1996 | Nye et al. | 399/237 |

FOREIGN PATENT DOCUMENTS 3-23480 1/1991 Japan .

*Primary Examiner*—Joan H. Pendegrass
*Assistant Examiner*—Quana Grainger
*Attorney, Agent, or Firm*—Tallam Nguti

[57] ABSTRACT

An electrostatographic liquid immersion development (LID) reproduction machine having an image bearing member and a multifunction image developer and conditioning apparatus that significantly reduces the number of components, size, costs, and shear-force related image defects of such machines. The multifunction apparatus includes a housing defining a sump portion, a recovery chamber, and an opening into the recovery chamber; liquid developer material contained in the sump portion for developing a latent image on the image bearing member; and a rotatable multifunction roller assembly for processing a developed image on the image bearing member. This roller assembly includes a rotatable roll having a porous metal core defining an inner surface, and a foam layer formed over the metal core defining a skin or outer surface. The rotatable roller is mounted partially within the recovery chamber and partially through the opening and into contact with the image bearing member to form an image processing nip therewith. The rotatable roller functions to transport liquid developer material into the image processing nip for developing a latent image on the image bearing member, and to apply a mechanical force against the image bearing member for compacting and stabilizing a developed image thereon. The roller assembly also includes a vacuuming device mounted inside the rotatable roller against the inner surface thereof for applying a liquid carrier removing vacuum to a portion of the inner surface of the rotatable roller within the image processing nip.

5 Claims, 2 Drawing Sheets

LIQUID IMMERSION DEVELOPMENT MACHINE HAVING AN IMAGE NON-SHEARING DEVELOPMENT AND CONDITIONING IMAGE PROCESSING DEVICE

BACKGROUND OF THE INVENTION

This invention relates to liquid immersion development (LID) reproduction machines, and more particularly to such a machine having an image non-shearing and economical multifunction image processing device.

Liquid electrophotographic reproduction machines are well known, and generally each includes an image bearing member or photoreceptor having an image bearing surface on which latent images are formed and developed as single color or multiple color toner images for eventual transfer to a receiver substrate or copy sheet. Each such reproduction machine thus includes a development system or systems that each utilizes a liquid developer material typically having about 2 percent by weight of charged, solid particulate toner material of a particular color, that is dispersed at a desired concentration in a clear liquid carrier.

In the electrophotographic process of a LID machine, the latent images formed on the image bearing surface of the image bearing member or photoreceptor are developed with the charged toner particles, with excess liquid carrier being left behind or removed such that the developed images typically each contain about 12 percent by weight of the toner particles. The developed image or images on the image bearing member are then further conditioned and subsequently electrostatically transferred from the image bearing surface to an intermediate transfer member. Following that, the conditioned image or images are then hot or heat transferred from the intermediate transfer member, at a heated transfer or transfix nip, to an output image receiver substrate or copy sheet.

LID machines, as above, conventionally include a liquid developer material or ink applicator for supplying or applying an even layer of the ink for image development. As pointed out, ink or liquid developer material being supplied by the applicator is about 2% solids (by weight) and developed images are on the order of 10% –15% solids (by weight). Such machines also include a biased metering roll for metering an amount of carrier fluid in the ink as well as for developing images with the metered ink. Fluid metering as such, and image development, are conventionally carried out separately, and typically by using a reverse rolling or moving metering roll. Reverse is used here in the sense that, in a nip formed between the separate metering roll and the image bearing member, the separate metering roll is moving in a direction opposite to that of the image bearing member. Reverse metering rolls have been found to produce images that are subjected to high drag out or smear effects due to high shear forces between the reverse roll and the image being developed.

LID machines typically also include a step of conditioning the initial ink developed image, so as to provide increased image stability, by raising the percent solids content of such image from the 10% –15% solids (by weight), to at least 25% (by weight). Conventionally, such image conditioning is accomplished using a device that is separate from the ink metering and image development devices. Disadvantages of conventional LID machines as such therefore include relatively larger machine architectures, relatively more machine components and hence greater costs, and relatively poorer image quality due to the shear forces.

There is therefore a need for a LID reproduction machine having an image non-shearing and economical multifunction image processing device.

SUMMARY OF THE INVENTION

In accordance with the present invention, there is provided in an electrostatographic liquid immersion development (LID) reproduction machine having an image bearing member, a multifunction image developer and conditioning apparatus that significantly reduces the number of machine components, machine size, machine costs, and shear-force related image defects of the machine. The multifunction apparatus includes a housing defining a sump portion, a recovery chamber, and an opening into the recovery chamber; liquid developer material contained in the sump portion for developing a latent image on the image bearing member; and a rotatable multifunction roller assembly for processing an image on the image bearing member. This multifunction roller assembly includes a rotatable roller having a porous metal core defining an inner surface, and a foam layer formed over the metal core defining a skin or outer surface of the roller. The rotatable roller is mounted partially within the recovery chamber and partially through the opening and into contact with the image bearing member to form an image processing nip therewith. The rotatable roller as mounted functions to transport liquid developer material into the image processing nip for developing a latent image on the image bearing member, and to apply a mechanical force against the image bearing member for compacting and stabilizing a developed image thereon. The multifunction roller assembly also includes a vacuuming device mounted inside the rotatable roller against the inner surface thereof for applying a vacuum to a portion of the inner surface of the rotatable roller to remove carrier liquid from liquid developer material on the outer surface of the rotatable roller.

BRIEF DESCRIPTION OF THE DRAWINGS

Other aspects of the present invention will become apparent as the following description proceeds and upon reference to the drawings, in which.

DETAILED DESCRIPTION OF THE INVENTION

Figure 1:
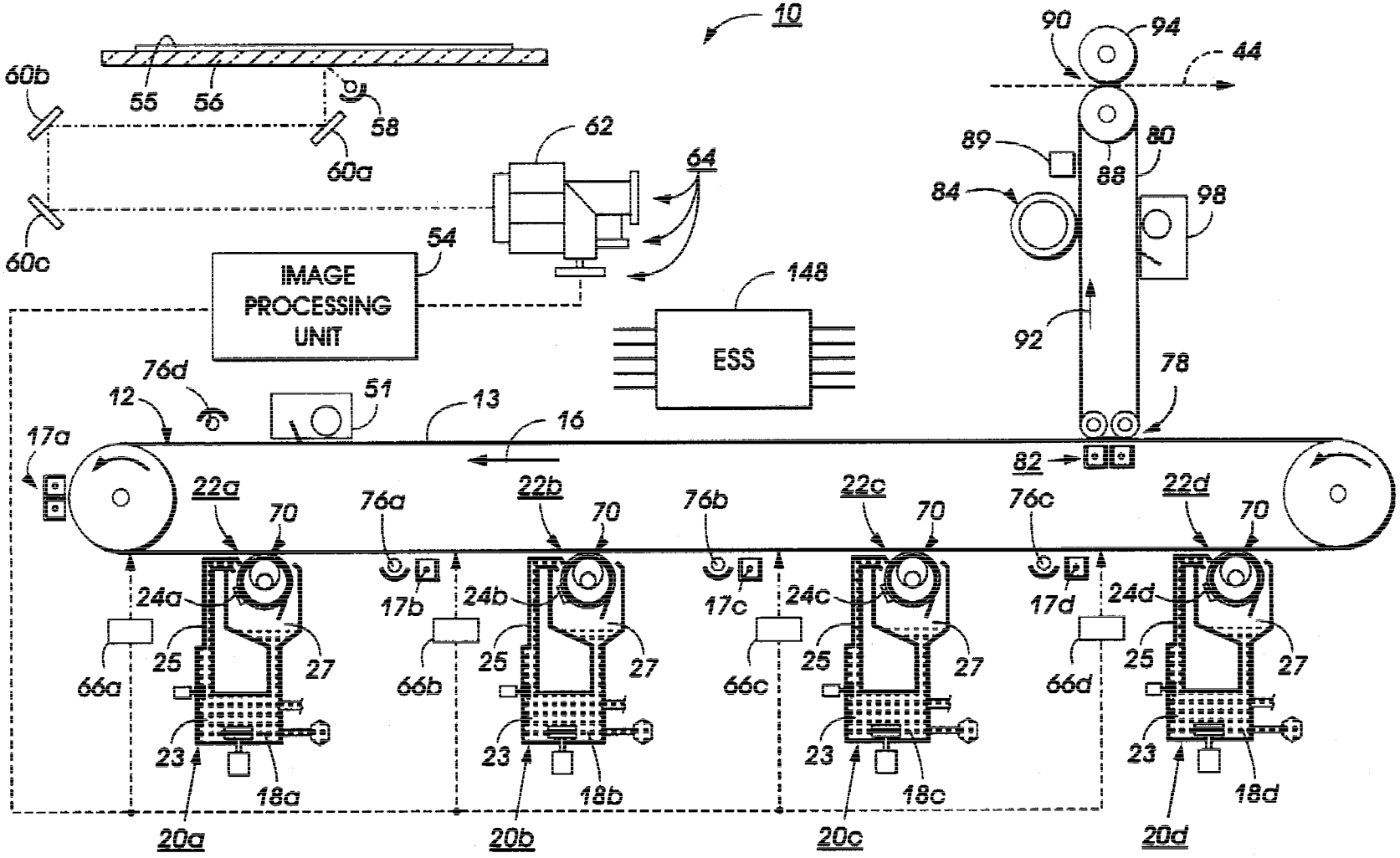
FIG. 1 is a vertical schematic of an exemplary color electrophotographic liquid immersion development (LID) reproduction machine incorporating an image non-shearing multifunction image processing device in accordance with the present invention.

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the FIGS. 1 and 2 of the reproduction machine will be shown hereinafter only schematically, and their operation described only briefly.

Referring now to FIG. 1, there is shown a color electrophotographic reproduction machine 10 incorporating a development system including the filming attenuation correcting toner concentration sensor assembly of the present invention. Although a multiple color LID machine is illustrated, it is understood that the invention is equally suitable for a single color LID machine. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors 60*a*, 60*b* and 60*c*, respectively through a set of lenses (not shown) and through a dichroic prism 62 to three charged-coupled devices (CCDs) 64 where the information is read. The reflected light is separated into the three primary colors by the dichroic prism 62 and the CCDs 64. Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel the color components as well as the color separation. Image processing unit 54 may contain a shading correction unit, an undercolor removal unit (UCR), a masking unit, a dithering unit, a gray level processing unit, and other imaging processing sub-systems known in the art. The image processing unit 54 can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive or image forming surface 13, and, in some embodiments, an anti-curl backing layer. As shown, belt 12 is movable in the direction of arrow 16. The moving belt 12 is first charged by a charging unit 17*a*. A raster output scanner (ROS) device 66*a*, controlled by image processing unit 54, then writes a first complementary color image bitmap information by selectively erasing charges on the charged belt 12. The ROS 66*a* writes the image information pixel by pixel in a line screen registration mode. It should be noted that either discharged area development (DAD) can be employed in which discharged portions are developed or charged area development (CAD) can be employed in which the charged portions are developed with toner.

Figure 2:
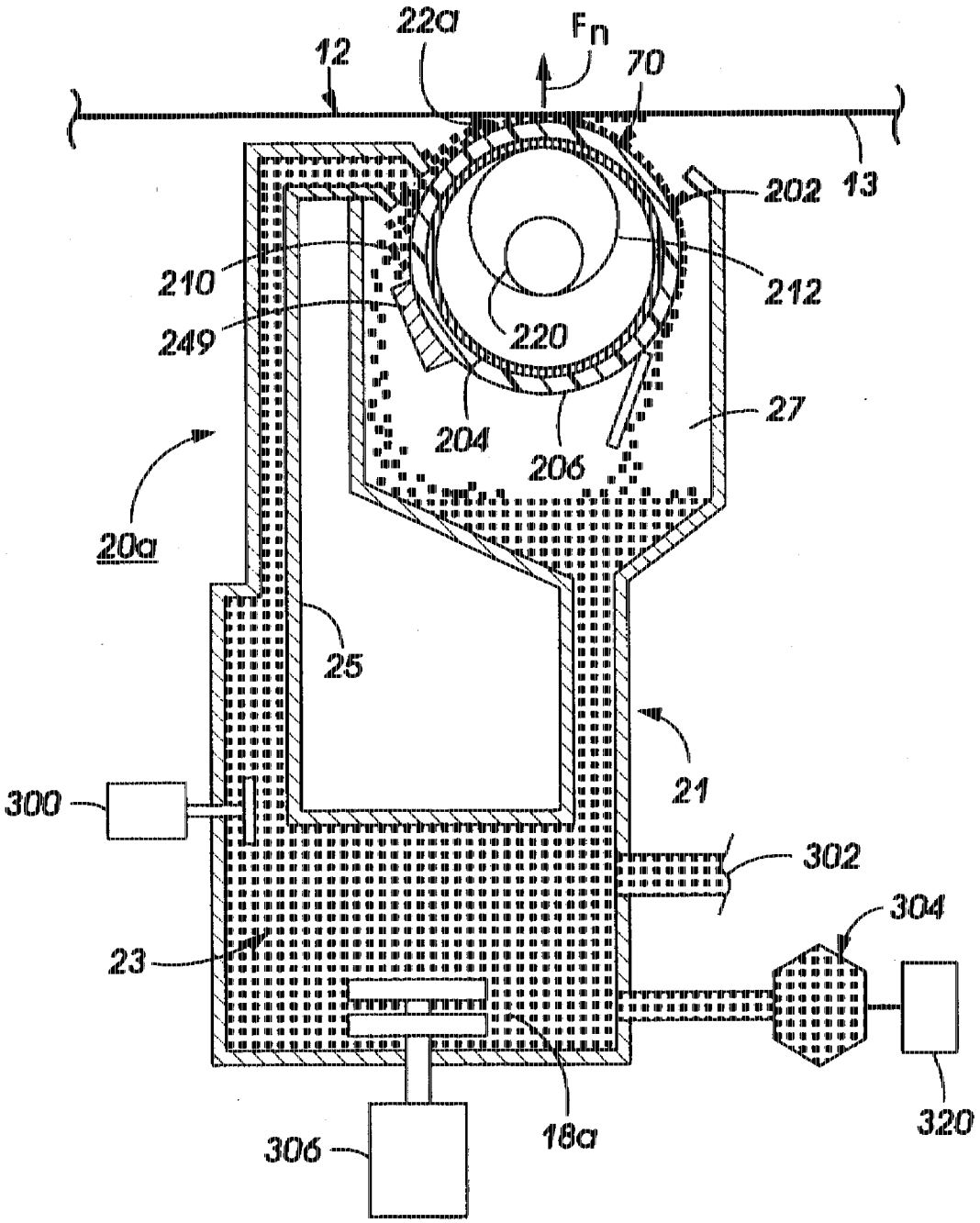
FIG. 2 is a vertical schematic of the image non-shearing multifunction image processing device of FIG. 1.

Referring now to FIGS. 1 and 2, after the electrostatic latent image has been recorded thus, belt 12 advances the electrostatic latent image to a first image non-shearing image processing device 20*a* in accordance with the present invention. Like subsequent image non-shearing image processing devices 20*b*, 20*c*, and 20*d*, the image non-shearing image processing device 20*a* is a single or unitary device as shown, and includes a housing 21 defining a mixing chamber 23, a developer material delivery conduit 25, a rotatable multifunction roller assembly 70 of the present invention, and a spent developer material recovery chamber 27. The rotatable multifunction roller assembly 70, rotating in a forward direction as shown, advances a quantity of liquid developer material 18*a*, preferably black toner developer material containing charged black toner particles at a desired concentration, delivered to the roller assembly 70 via the conduit 25, into a multifunction image processing nip 22*a*. An electrode 24*a* positioned before the entrance to the multifunction image processing nip 22*a* is electrically biased to generate an AC field just prior to the entrance to the nip 22*a* so as to disperse the toner particles substantially uniformly throughout the liquid carrier. The toner particles, disseminated at the desired concentration through the liquid carrier, pass by electrophoresis to the electrostatic latent image forming a first liquid color separation developed image. As is well known, the charge of the toner particles is opposite in polarity to the charge on the photoconductive or image forming surface 13.

After the first liquid toner color separation image is formed in accordance with the present invention (to be described in detail below), for example, with black liquid toner, it is advanced on belt 12 to lamp 76*a* where residual charge left on the photoconductive surface 13 is erased by flooding the photoconductive surface with fight from lamp 76*a*.

As shown, according to the REaD process of the machine 10, the liquid toner image on belt 12 is subsequently recharged with charging unit 17*b*, and is next re-exposed by ROS 66*b*. ROS 66*b* superimposing a second color image bitmap information over the previous developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration. At the second image non-shearing image processing device 20*b* in accordance with the present invention, a rotatable multifunction roller assembly 70, rotating in a forward direction as shown, advances a liquid developer material 18*b*, containing toner particles at a desired toner concentration, from the delivery conduit 25, to a second multifunction image processing nip 22*b*. An electrode 24*b* positioned before the entrance to multifunction image processing nip 22*b* is electrically biased to generate an AC field just prior to the entrance to the nip 22*b* so as to disperse the toner particles substantially uniformly throughout the liquid carrier. The toner particles, disseminated through the liquid carrier, pass by electrophoresis to the previously formed liquid toner image. The charge of the toner particles is opposite in polarity to the charge on the previous developed image.

The images on belt 12 are advanced to lamp 76*b* where any residual charge left on the photoconductive surface is erased by flooding the photoconductive surface with light from lamp 76*b*. Then to similarly produce the third color separation image using the third toner color, for example magenta color toner, the toner images on moving belt 12 are recharged with charging unit 17*c*, and re-exposed by a ROS 66*c*, which superimposes a third color image bitmap information over the previous developed latent image. At the third image non-shearing image processing device 20*c* in accordance with the present invention, a rotatable multifunction roller assembly 70, rotating in a forward direction as shown, advances magenta liquid developer material 18*c*, containing toner particles at a desired toner concentration, from the delivery conduit 25, to a third multifunction image processing nip 22*c*. An electrode 24*c* positioned before the entrance to the processing nip 22*c* is electrically biased to generate an AC field just prior to the entrance the nip 22c so as to disperse the toner particles substantially uniformly throughout the liquid carrier. The toner particles, disseminated through the liquid carrier, pass by electrophoresis to the previously formed toner images.

The images or composite image on belt 12 are advanced to lamp 76c where any residual charge left on the photoconductive surface of belt 12 is erased by flooding the photoconductive surface with light from the lamp. Then finally, to similarly produce the fourth image using the fourth toner color, for example cyan color toner, the toner images on moving belt 12 are recharged with charging unit 17d, and re-exposed by a ROS 66d. ROS 66d superimposes a fourth color image bitmap information over the previous developed latent images. At the fourth image non-shearing image processing device 20d in accordance with the present invention, rotatable multifunction roller assembly 70, rotating in a forward direction as shown, advances a cyan liquid developer material 18d, containing toner particles at a desired toner concentration, from the delivery conduit 25, to a fourth multifunction image processing nip 22d. An electrode 24d positioned before the entrance to multifunction image processing nip 22d is electrically biased to generate an AC field just prior to the entrance to the nip 22d so as to disperse the toner particles substantially uniformly throughout the liquid carrier. The toner particles, disseminated through the liquid carrier, pass by electrophoresis to the previous developed image. It should be evident to one skilled in the art that the color of toner at each image non-shearing image processing device could be in a different arrangement.

The resultant composite multicolor image, a multi layer image by virtue of different color toner development by the devices 20a, 20b, 20c and 20d, respectively having black, yellow, magenta, and cyan, toners, is then advanced to an intermediate transfer station 78. At the transfer station 78, the multicolor image is electrostatically transferred to an intermediate member 80 with the aid of a charging device 82. Intermediate member 80 may be either a rigid roll or an endless belt, as shown, having a path defined by a plurality of rollers in contact with the inner surface thereof. The multicolor image on the intermediate transfer member 80 is conditioned again for example by a blotter roller 84 which further reduces the fluid content of the transferred image by compacting the toner particles thereof while inhibiting the departure of the toner particles. Blotter roller 84 is adapted to condition the image so that it has a toner composition of more than 50 percent solids.

Subsequently, the reconditioned image on the surface of the intermediate member 80 is advanced through a liquefaction stage before being transferred within a second transfer nip 90 to an image recording sheet 44. Within the liquefaction stage, particles of toner forming the transferred image are transformed by a heat source 89 into a tackified or molten state. The heat source 89 can also be applied to member 80 internally. The intermediate member 80 then continues to advance in the direction of arrow 92 until the tackified toner particles reach the transfer nip 90.

The transfer nip 90 is more specifically a transfixing nip, where the multicolor image is not only transferred to the recording sheet 44, but it is also fused or fixed by the application of appropriate heat and pressure. At transfix nip 90, the liquefied toner particles are formed, by a normal force applied through a backup pressure roll 94, into contact with the surface of recording sheet 44. Moreover, recording sheet 44 may have a previously transferred toner image present on a surface thereof as the result of a prior imaging operation, i.e. duplexing. The normal force, produces a nip pressure which is preferably about 20 psi, and may also be applied to the recording sheet via a resilient blade or similar spring-like member uniformly biased against the outer surface of the intermediate member across its width.

As the recording sheet 44 passes through the transfix nip 90 the tackified toner particles wet the surface of the recording sheet, and due to greater attractive forces between the paper and the tackified particles, as compared to the attraction between the tackified particles and a liquid-phobic surface of member 80, the tackified particles are completely transferred to the recording sheet. As shown, the surface of the intermediate transfer belt 80 is thereafter cleaned by a cleaning device 98 prior to receiving another toner image from the belt 12.

Invariably, after the multicolor image was transferred from the belt 12 to intermediate member 80, residual liquid developer material remained adhering to the photoconductive surface of belt 12. A cleaning device 51 including a roller formed of any appropriate synthetic resin, is therefore provided as shown and driven in a direction opposite to the direction of movement of belt 12 to scrub the photoconductive surface clean. It is understood, however, that a number of photoconductor cleaning means exist in the art, any of which would be suitable for use with the present invention. Any residual charge left on the photoconductive surface after such cleaning is erased by flooding the photoconductive surface with light from a lamp 76d prior to again charging the belt 12 for producing another multicolor image as above.

As illustrated the reproduction machine 10 further includes an electronic control subsystem (ESS) shown as 148 for controlling various components and operating subsystems of the reproduction machine. ESS 148 thus may be a self-contained, dedicated minicomputer, and may include at least one, and may be several programmable microprocessors for handling all the control data including control signals from control sensors for the various controllable aspects of the machine.

Referring now to FIG. 2, in accordance with the present invention, a single multifunction LID image development and conditioning device 20a, 20b, 20c, 20d is provided for metering the liquid developer material, developing an image with the metered developer material to create a developed image, and conditioning the developed image by raising its solids content from the 10% –15% solids (by weight), to at least 25% (by weight). The multifunction LID image development and conditioning device 20a, 20b, 20c, 20d includes the rotatable multifunction roller assembly 70 that has a rotatable, porous roller 202. The roller 202 has a metal core 204 and a wrapped, conductive foam outer layer or skin 206 for receiving liquid developer material from an applicator tip, for example, 25a, and for moving the received developer material, through the image processing nip 22a, 22b, 22c, and 22d, in the same or forward direction as the moving image bearing member 12 bearing an image to be developed.

The image processing nip 22a, 22b, 22c, and 22d, as such, is a multifunction metering, image development, and image conditioning nip. Importantly, each image processing nip 22a, 22b, 22c, and 22d is sized so as to significantly restrict and reduce the mount of carrier fluid or liquid that is able to be passed through such nip between the image being developed and the outer surface of the roller 202. The result is a sizable meniscus 210 (of the carrier fluid) formed upstream of such nip as metered, higher solids content, ink or developer material on the outer surface of the roller 202, enters the nip. As the metered ink or developer material enters the nip, the electrode 24*a*, 24*b*, 24*c*, 24*d* provides an electric field that either develops images in image areas or cleans background areas of an image frame, as is well known in the art.

The multifunction LID image development and conditioning device 20*a*, 20*b*, 20*c*, 20*d* further includes a vacuuming device 212 that is mounted within the metal core 204 of the roller 202 for removing carrier fluid from liquid ink or developer material on the outer surface of the roller 202. As such, carrier fluid is also removed from the sizable meniscus 210. Typically the carrier fluid being removed is pulled by applied vacuum from the developer material on the roller 202 through its outer porous foam or skin layer, and through its porous metal core into a collection and takeaway element 220 within the vacuum device 212.

The roller 202 is mounted so that within the image processing nip 22*a*, 22*b*, 22*c*, and 22*d*, it applies a mechanical force Fn to the image that is being developed and being conditioned on the image bearing member 12. The force Fn advantageously acts to restrict the amount of carrier fluid let into the nip, as well as to compact the toner image, thus making it more stable, which is particularly necessary for an image-on-image system such as the REaD system described above. The advantageous results include a single and simple one step multifunction device and method of achieving quality toner developed images that are conditioned to about 25% solids (by weight). Other advantages include a possible smaller machine architecture; fewer process components; increased developed image quality since developed images are no longer subjected to high shear forces as are present in a reverse metering process.

Each image non-shearing multifunction image processing device 20*a*, 20*b*, 20*c*, 20*d* includes means such as a pump 300 for moving mixed developer material from the sump 23 through the conduit 25, to the image processing nip such as 22*a*. Fresh or replenishment liquid developer material is supplied to the mixing sump 23 through a supply source 302, and toner concentrate can be controllably supplied from a source 304 for adjusting and controlling the toner concentration of the liquid developer material being mixed in the mixing sump 23. A mixing device 306 mixes liquid developer material within the mixing sump 23.

As can be seen, an image non-shearing multifunction image processing device has been provided and includes a multifunction liquid developer metering, image development, and image conditioning roller assembly. The roller assembly includes a rotatable roller having a foam layer defining an inner surface, and a skin layer formed over the foam layer defining an outer surface. The rotatable roller is mounted partially within a recovery chamber and partially through an opening into contact with the image bearing member forming an image processing nip therewith. The rotatable roller functions to transport liquid developer material into the image processing nip for developing a latent image on the image bearing member, and to apply a mechanical force against the image bearing member for compacting and stabilizing a developed image thereon.

The roller assembly also includes a vacuuming device mounted within the multi-function roller against the inner surface for applying a liquid carrier removing vacuum to a portion of the inner surface, thereby compacting and economically simplifying the development metering and conditioning aspects of the liquid immersion development reproduction machine.

As further shown, the image non-shearing multifunction image processing device includes liquid developer material delivery means connected to a sump portion for delivering liquid developer material onto the outer surface of the rotatable roller, upstream of the image processing nip, relative to a movement of the image bearing member through the image processing nip. Importantly in accordance with the present invention, in the image processing nip, the rotatable roller is moving in the same direction as the image bearing member.

As also further shown, the image non-shearing multifunction image processing device also includes adding means for adding a controllable amount of charged toner particles into the sump portion so as to maintain at a desired level, a toner particle concentration of the liquid developer material being delivered onto the rotatable roller.

To summarize, an electrostatographic liquid immersion development (LID) reproduction machine is provided having an image bearing member, a single, multifunction image developer and conditioning device that significantly reduces the size of such a machine, the number of components, costs and shear-force related image defects. The single, multifunction image developer and conditioning device or apparatus includes a housing mounted against the image bearing member, defining a sump portion, a recovery chamber, and an opening into the recovery chamber; liquid developer material contained in the sump portion including a liquid carrier and charged toner particles for developing a latent image on the image bearing member; and a multifunction liquid developer metering, image development, and image conditioning roller assembly. This rotatable roller assembly includes a rotatable roll having a porous metal core defining an inner surface, and a foam layer over the metal core defining a skin or outer surface of the roller. The rotatable roller is mounted partially within the recovery chamber and partially through the opening and into contact with the image bearing member to form an image processing nip therewith, and functions to transport liquid developer material into the image processing nip for developing a latent image on the image bearing member, and to apply a mechanical force against the image bearing member for compacting and stabilizing a developed image thereon. The multifunction liquid developer metering, image development, and image conditioning roller assembly also includes a vacuuming device mounted inside the rotatable roller against the inner surface thereof for applying a liquid carrier removing vacuum to a portion of the inner surface of the rotatable roller within the image processing nip.

While the invention has been described with reference to particular preferred embodiments, the invention is not limited to the specific examples shown, and other embodiments and modifications can be made by those skilled in the art without depending from the spirit and scope of the invention and claims.

What is claimed is:

1. A liquid immersion development (LID) reproduction machine comprising:

(a) a movable image bearing member having an image forming surface defining a path of movement;

(b) means mounted along said path of movement for forming a latent image onto said image forming surface;

(c) a unitary image developer and conditioning apparatus mounted along said path of movement containing liquid developer material consisting of a liquid carrier and solid charged toner particles at a desired concentration for developing and conditioning the latent image to create a toner developed image, said image developer and conditioning apparatus including:

(i) a housing defining an opening, a recovery chamber, and a sump containing said liquid developer material;

(ii) a rotatable multi-function roll having a thickness defining an outer surface and an inner surface, said multi-function roll being mounted partially within said recovery chamber and partially through said opening, said outer surface of said multi-function roll forming an image development and conditioning nip against said image forming surface of said image bearing member, said development and conditioning nip being sized for significantly restricting carrier fluid flow into said nip thereby forming a sizable meniscus of carrier fluid upstream of said nip, and said outer surface of said multi-function roll moving in a same direction as said image forming surface through said nip;

(iii) means connected to said sump for delivering liquid developer material from said sump onto said multi-function roll, upstream of said image development and conditioning nip, relative to movement of said image forming surface; and (iv) a vacuuming device mounted within said multi-function roll against said inner surface for applying a liquid carrier removing vacuum to a portion of said thickness of said multi-function roll within said image development and conditioning nip, thereby compacting and economically simplifying development, metering, and conditioning aspects of the liquid immersion development reproduction machine.

2. In an eleotrostatographic liquid immersion development (LID) reproduction machine having an image bearing member, a unitary, image developer and conditioning apparatus comprising:

(a) a housing mounted against the image bearing member, said housing defining a sump portion, a recovery chamber, and an opening into said recovery chamber;

(b) liquid developer material contained in said sump portion including a liquid carrier and charged toner particles for developing a latent image on said image bearing member; and (c) a multifunction liquid developer metering, image development, and image conditioning assembly, including:

(i) a rotatable roll having a foam layer defining an inner surface, and a skin layer formed over said foam layer defining an outer surface, said rotatable roll being mounted partially within said recovery chamber and partially through said opening into contact with said image bearing member forming an image processing nip therewith, said rotatable roll transporting liquid developer material into said image processing nip for developing a latent image on said image bearing member, said image processing nip being sized for significantly restricting carrier fluid flow into said nip thereby forming a sizable meniscus of carrier fluid upstream of said nip, and said rotatable roll applying a mechanical force against said image bearing member for compacting and stabilizing a developed image thereon; and (ii) a vacuuming device mounted within said rotatable roll against said inner surface for applying a liquid carrier removing vacuum to a portion of said thickness of said rotatable roll within said image development and conditioning nip, thereby compacting and economically simplifying development metering and conditioning aspects of the liquid immersion development reproduction machine.

3. The image developer and conditioning apparatus of claim 2, including liquid developer material delivery means connected to said sump for delivering liquid developer material onto said outer surface of said rotatable roll, upstream of said image processing nip, relative to a movement of said image bearing member through said image processing nip.

4. The image developer and conditioning apparatus of claim 3, wherein within said image processing nip, said rotatable roll is moving in the same direction as said image bearing member.

5. The image developer and conditioning apparatus of claim 3, including adding means for adding a controllable amount of charged toner particles into said sump portion so as to maintain at a desired level, a toner particle concentration of the liquid developer material being delivered onto said rotatable roll.

* * * * *